US007278558B1

(12) United States Patent
Sutton et al.

(10) Patent No.: US 7,278,558 B1
(45) Date of Patent: Oct. 9, 2007

(54) GARMENT HANGER WITH REMOVABLE SIDE INDICATOR

(75) Inventors: Steven Sutton, Brooklyn, NY (US); James Capuano, Middle Village, NY (US)

(73) Assignee: The Accessory Corp., New York, NY (US)

( * ) Notice: Subject to any disclaimer, the term of this patent is extended or adjusted under 35 U.S.C. 154(b) by 175 days.

(21) Appl. No.: 11/069,346

(22) Filed: Mar. 1, 2005

(51) Int. Cl.
*A41D 27/22* (2006.01)

(52) U.S. Cl. ..... 223/85

(58) Field of Classification Search ..... 223/85–98; D6/328

See application file for complete search history.

(56) References Cited

U.S. PATENT DOCUMENTS 4,006,547 A 2/1977 Samuels et al.
4,322,902 A 4/1982 Lenthall
4,333,590 A 6/1982 Princiotta
4,754,643 A 7/1988 Weeks, Jr. et al.
5,096,101 A 3/1992 Norman et al.
5,238,159 A 8/1993 Zuckerman
5,272,806 A 12/1993 Marshall et al.
5,305,933 A 4/1994 Zuckerman
5,377,884 A 1/1995 Zuckerman
5,383,583 A 1/1995 Zuckerman
5,388,354 A 2/1995 Marshall et al.
5,407,109 A 4/1995 Zuckerman
5,417,352 A 5/1995 Jen
5,441,182 A 8/1995 Sullivan
5,449,099 A 9/1995 Blanchard
5,469,995 A 11/1995 Bredeweg et al.
5,477,995 A 12/1995 Dooley et al.
5,485,943 A 1/1996 Zuckerman
5,503,310 A 4/1996 Zuckerman et al.
5,507,086 A 4/1996 Marshall et al.
5,524,801 A 6/1996 Dooley et al.
5,586,697 A 12/1996 Johansson
5,590,822 A 1/1997 Zuckerman
5,597,100 A 1/1997 Blitz
5,603,437 A 2/1997 Zuckerman
5,611,469 A 3/1997 Eiley et al.
5,628,132 A 5/1997 Marshall et al.
5,641,100 A 6/1997 Mitchell et al.
5,642,840 A 7/1997 Abdi
5,649,651 A 7/1997 Lam
5,687,887 A 11/1997 Bond et al.
5,819,995 A 10/1998 Zuckerman
5,944,237 A 8/1999 Gouldson
6,019,260 A 2/2000 Gouldson
6,041,983 A 3/2000 Sullivan et al.
6,041,984 A 3/2000 Gouldson
6,145,713 A 11/2000 Zuckerman
6,189,746 B1 2/2001 Gouldson
6,264,075 B1 7/2001 Gouldson et al.
6,378,744 B2 4/2002 Olk et al.
6,382,478 B2 5/2002 Gouldson et al.
6,422,437 B2 7/2002 Gouldson et al.
6,499,633 B1 12/2002 Pogmore
6,499,634 B2 12/2002 Olk et al.
6,564,980 B2 5/2003 Gouldson et al.
6,865,832 B1 3/2005 Goldman
6,874,666 B2 4/2005 Gouldson et al.

*Primary Examiner*—Shaun R. Hurley
(74) *Attorney, Agent, or Firm*—Gordon & Jacobson, PC

(57) ABSTRACT

A hanger according to the invention includes a cross member with a centrally located hook. A web is formed between the hook and the cross member and is adapted to receive a conventional indicator. The web includes a rib, followed by a valley, followed by a plateau. According to the invention, the rib is beveled at the top and a notch is provided in the web adjacent the top of the rib. The indicator is easily attached and removed from the top of the rib. Removal can be effected by inserting a fingernail into the notch and leveraging the top of the indicator.

20 Claims, 4 Drawing Sheets

GARMENT HANGER WITH REMOVABLE SIDE INDICATOR

BACKGROUND OF THE INVENTION

1. Field of the Invention

This invention relates broadly to garment hangers. More particularly, this invention relates to a garment hanger having a removable side size indicator.

2. State of the Art

For purposes of displaying garments suspended on hangers in an orderly manner to the retail customer, certain retail stores desire to affix an indicating means on the side of the hook of the hanger where the hook meets the hanger body. The indicating means identifies some attribute of the garment suspended from the hanger, such as size, quality, color, manufacturing data, or pattern.

To accommodate the various types of hangers available in the industry, numerous indicating means have been developed in a variety of shapes, sizes and materials. Similarly, hangers have been developed to accommodate a variety of different indicating means. Generally, the indicating means is attached to the hanger at the time that the clothing is attached to the hanger. In many cases, once the indicating means is attached to the hanger, it is difficult or impossible to remove without destroying it and damaging the hanger. This may or may not be a disadvantage. In situations where the purchaser takes the clothing with the hanger, e.g. where the hanger may be used by the purchaser to hang the clothes in the purchaser's wardrobe, this does not generally present a problem. Some clothing which is displayed on hangers at the store is not kept on hangers once purchased. These items of clothing include underwear and swimwear. Typically, the cashier will detach the clothing from the hanger and discard the hanger before packaging the clothing for the purchaser. In many instances, these items of clothing are attached to the hangers at their place of manufacture and then shipped to retailers in the U.S. In most cases, the cost of returning used hangers to the manufacturer outweighs the cost of new hangers. In cases where it is less expensive to recycle the hangers than to buy new hangers, the cost of sorting the hangers according to their indicator makes this practice uneconomical. If, however, the indicating means could be easily removed and replaced without damaging the hanger, then recycling of hangers would be economical.

U.S. Pat. No. 6,189,746 discloses a molded plastic garment hanger having a hook with a web adjacent the hook and a hanger body, wherein the web is received within a cavity of a molded plastic indicator having side walls. The web is formed with a detachment opening which extends under the indicator to allow the indicator to be removed when a detachment wedge is inserted in the opening. While this hanger arrangement is effective, it has the disadvantage of requiring a tool to remove the indicator. It is also dangerous in that when the tool is applied to remove the indicator, the indicator is allowed to fly off the hanger in an unpredictable direction. This projectile can strike someone in the face or eye and cause serious injury.

SUMMARY OF THE INVENTION

It is therefore an object of the invention to provide a garment hanger with a removable indicator.

It is another object of the invention to provide a garment hanger with a removable indicator which can be removed without requiring a tool.

It is still another object of the invention to provide a means for removing the indicator which is safe and does not result in the indicator becoming a projectile.

In accord with these objects, which will be discussed in detail below, a hanger according to the invention includes a cross member with a centrally located hook. A web is formed between the hook and the cross member and is adapted to receive an indicator such as the indicator disclosed in the previously mentioned U.S. Pat. No. 6,189,746, the complete disclosure of which is incorporated by reference herein. The web includes (on each side) a rib, followed by a valley, followed by a plateau. According to the invention, the rib is beveled at the top, has a thick base, and a notch is provided in the web adjacent the top of the rib. A gradual rise or ramp is located between the valley and the plateau. The indicator is generally U-shaped with inwardly turned ends and a pair of interior fingers. The indicator is easily attached by sliding it over the beveled top of the rib and then down to the thick base of the rib. When attached to the web, the internal fingers of the indicator embrace the rib and the inwardly turned ends lie adjacent the ramp on each side of the web. The indicator is easily and safely removed from the top of the rib by inserting a fingernail or instrument into the notch and leveraging the top of the indicator. In an alternate embodiment, the rib is beveled at the bottom and a notch is provided in the web adjacent the bottom of the rib.

Additional objects and advantages of the invention will become apparent to those skilled in the art upon reference to the detailed description taken in conjunction with the provided figures.

BRIEF DESCRIPTION OF THE DRAWINGS

FIG. 2 is an enlarged view of the web looking edge on;

DETAILED DESCRIPTION

Figure 1:
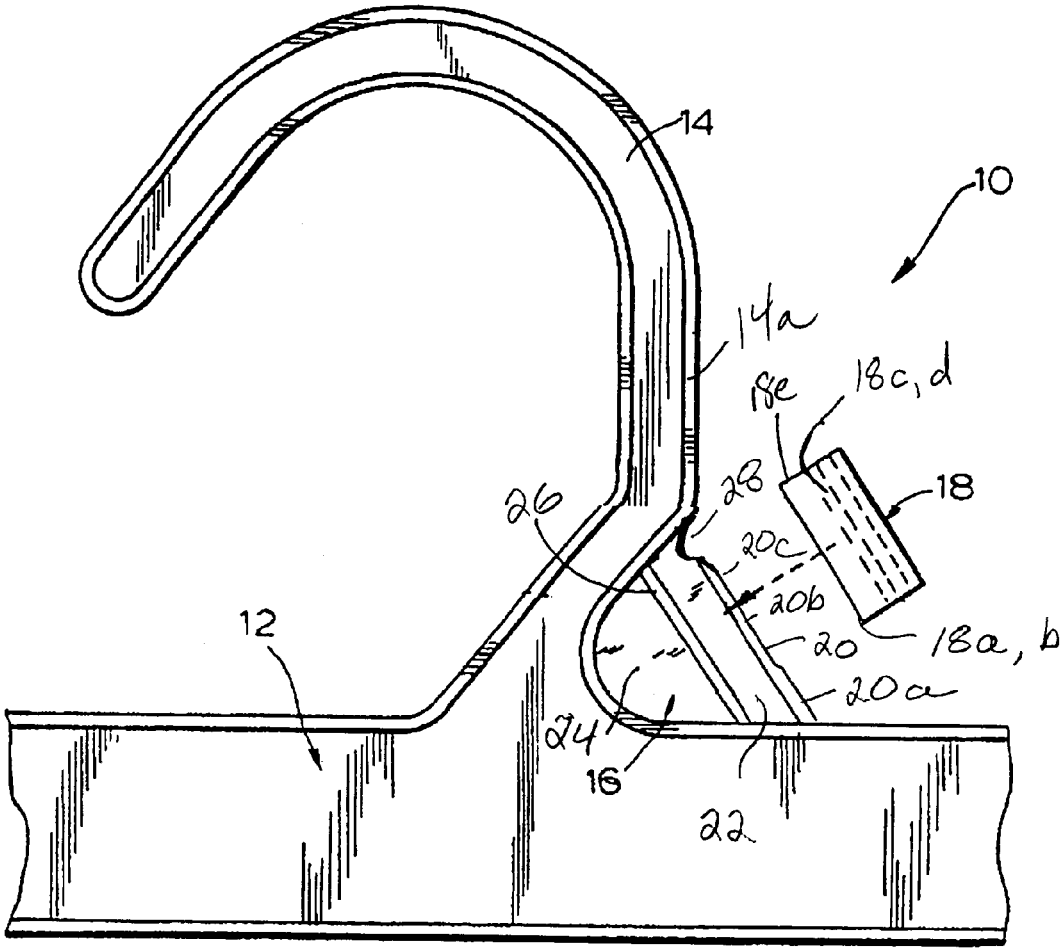
FIG. 1 is a broken side elevation view illustrating a hanger according to the invention and a conventional indicator.

Turning now to FIG. 1, a hanger 10 includes a cross member 12 and a centrally located hook 14. Although the ends of the cross member 12 are not illustrated, those skilled in the art will appreciate that the ends may be provided with clamps or other means for grasping or engaging a garment. A web 16 is formed between cross member 12 and the hook 14 and is adapted to receive an indicator 18. More particularly, the web 16 defines (on each side thereof) a rib 20 followed by a valley 22 followed by a plateau 24. A ramp 26 is provided between the valley 22 and the plateau 24. A notch 28 is provided above the rib 20, i.e. between the rib 20 and the hook 14, such that the plateau 24 is accessible without engaging the rib 20.

Figure 2:
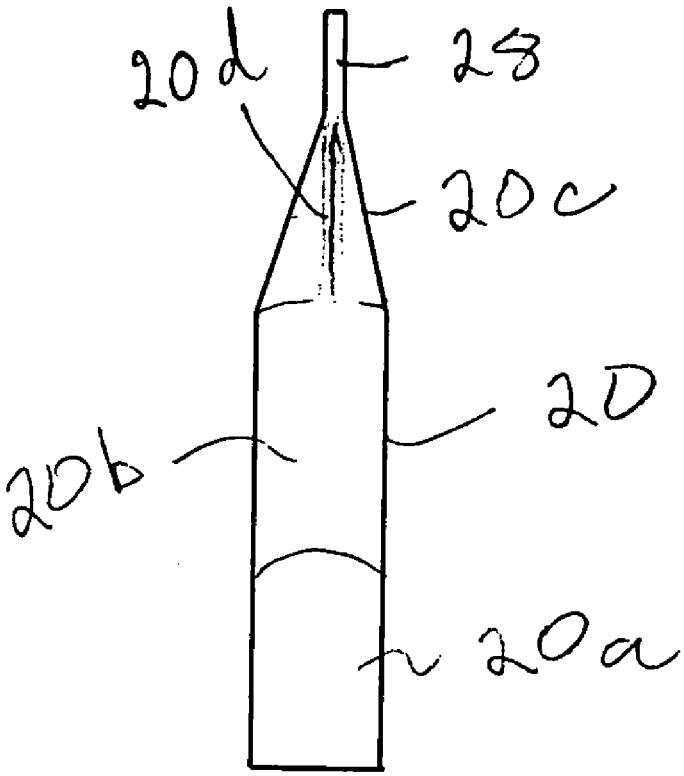
Figure 3:
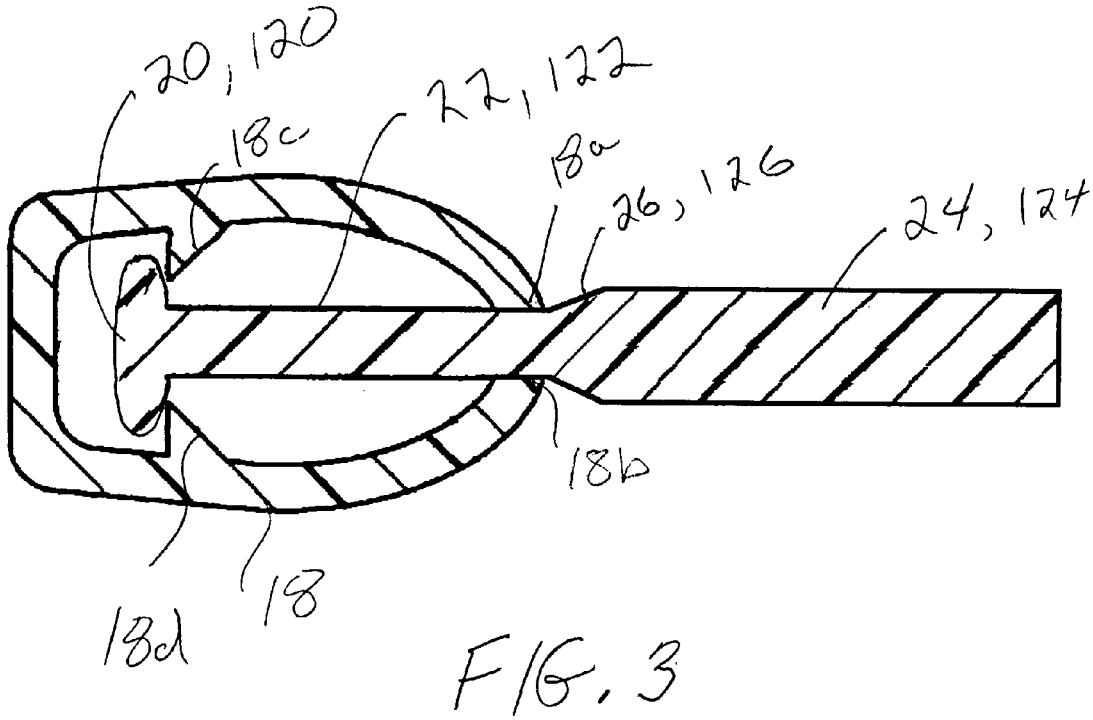
FIG. 3 is a sectional view of a portion of the hanger with the indicator attached.

Referring now to both FIGS. 1 and 2, the rib 20 has three portions: a thick base 20*a*, a thinner middle portion 20*b*, and a thinner beveled top 20*c*. It should be noted that the hook 14 has a vertical component which extends upward from the notch 28 thereby exposing the beveled top 20*c* of the rib 20. It should also be noted that the beveled portion preferably tapers in two dimensions. Thus, the beveled top 20*c* tapers in width (compare the width of middle portion 20*b* and width of the plateau 26 at notch 28) as seen best in FIG. 2 in the z-plane (into and out of the page), and likewise tapers in thickness, as seen best in FIG. 1 (along an axis perpendicular to the direction of the ramp 26 and rib 20). The sides of beveled top 20*c* are also preferably sloped on each side to a middle ridge 20*d* as seen in FIG. 2

As mentioned above, the indicator 18 is conventional. It is generally U-shaped with walls terminating in inwardly turned legs 18*a*, 18*b* and with a pair of inwardly extending fingers 18*c*, 18*d*. The indicator 18 is attached to the web 16 in either of two ways. It can be snapped directly over the rib 20 by moving the indicator in the direction of the arrow shown in FIG. 1. Alternatively, an end of the indicator (identified in FIG. 1 as 18*e*) may be located over the notch with the indicator angled (e.g., at thirty degrees) relative to the rib 20. The middle and/or bottom of the indicator is then pushed such that the legs 18*a*, 18*b* of the indicator pass over the beveled portion 20*c* and the middle portion 20*b* of the rib 20 and followed by the fingers 18*c*, 18*d* passing over portions 20*c* and 20*b*. This causes the fingers 18*c*, 18*d* to embrace the middle portion 20*b* of the rib 20 and the edges 18*a*, 18*b* to abut the ramp 26 and is audible with a snapping sound. The thick base 20*a* of the rib 20 prevents the indicator 18 from sliding down away from the hook 14 leaving only a small space between the indicator and the hook near the notch 28.

The indicator 18 can be removed safely from the web 16 by inserting a tool or one's fingernail into the small space between the top of the indicator 18 and the hook 14 and into the notch 28 whereby the top of the indicator can be leveraged away from the notch 28 and lifted up off the rib 20. Though not illustrated, those skilled in the art will appreciate that the indicator 18 is preferably provided with indicia to indicate the size of the garment for example.

Figure 4:
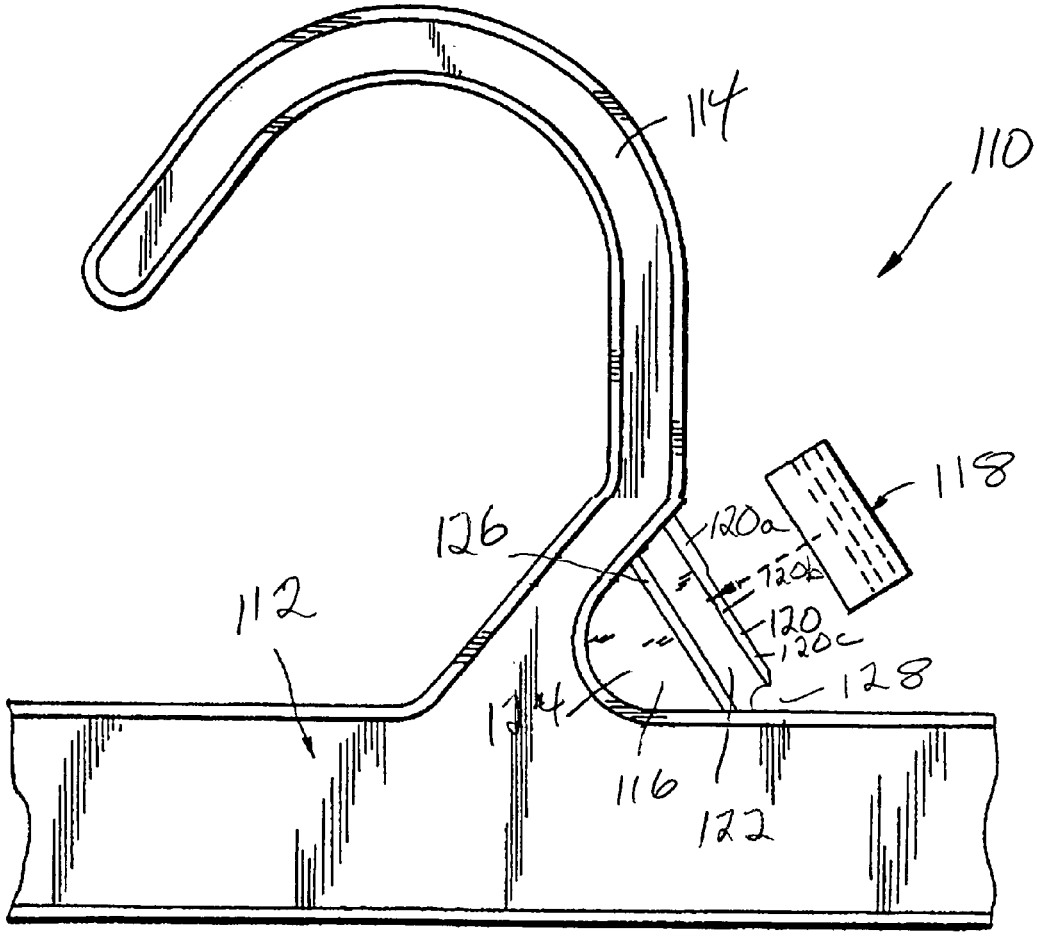
FIG. 4 is a view similar to FIG. 2 illustrating an alternate embodiment.

FIG. 4 shows an alternate embodiment of a hanger 110 which is similar to the hanger 10 with similar reference numerals (increased by 100) referring to similar features. Here, the configuration of the rib 120 is opposite to that of the rib 20 in the hanger 10. The top portion 120*a* of the rib is thick and below it is the middle portion 120*b* with the bevel being provided at the bottom 120*c*. The notch 128 is located between the lower end of the rib 120 and the cross member 112. Hook 114, plateau 124, ramp 126, and valley 122 are substantially identical to their counterparts of FIG. 1.

There have been described and illustrated herein a garment hanger with a removable side indicator. While particular embodiments of the invention have been described, it is not intended that the invention be limited thereto, as it is intended that the invention be as broad in scope as the art will allow and that the specification be read likewise. For example, while a hanger has been shown with a horizontal cross member, the cross member could be angled down on either side of the hook as is seen in many garment hangers. It will therefore be appreciated by those skilled in the art that yet other modifications could be made to the provided invention without deviating from its spirit and scope as claimed.

What is claimed is:

1. A garment hanger, comprising:

a cross member;

a hook extending up from said cross member; and a web extending between the hook and the cross member, said web defining an edge and said edge defining a rib, said rib having a beveled portion, wherein said web defines a notch adjacent to said beveled portion of said rib and adjacent to one of said hook and said cross member.

2. The hanger according to claim 1, wherein:

said notch is adjacent to said hook.

3. The hanger according to claim 1, wherein:

said notch is adjacent to said cross member.

4. The hanger according to claim 1, further comprising:

a removable indicator having internal means for engaging said rib.

5. The hanger according to claim 1, wherein:

said rib has two ends, said beveled portion being at one end and the other end being thickened with a thinner portion between said ends.

6. The hanger according to claim 1, wherein:

said web further defines a valley adjacent to said rib, and a plateau adjacent to said valley.

7. A garment hanger comprising:

a cross member;

a hook extending up from said cross member; and a web extending between the hook and the cross member, said web defining an edge and said edge defining a rib, said rib having a beveled portion, wherein said web further defines a valley adjacent to said rib, and a plateau adjacent to said valley and said web defines a ramp between said valley and said plateau.

8. The hanger according to claim 1, wherein:

said hook has a vertical component which is adjacent said notch.

9. The hanger according to claim 4, wherein:

said internal means include a pair of fingers.

10. The hanger according to claim 9, wherein:

said indicator is substantially U-shaped with inwardly turned ends.

11. The hanger according to claim 10, wherein:

said web further defines a valley adjacent to said rib, a plateau adjacent to said valley, and a ramp between said valley and said plateau, and said indicator fingers embrace said rib and said inwardly turned ends abut said ramp.

12. A method of removing an indicator from a web on a garment hanger having a hook and a cross member with the web extending therebetween, the web defining an edge, and said edge defining a rib and a notch adjacent the rib, the method comprising:

inserting a tool or one's fingernail into a space between the indicator and the hook or cross member and into the notch in the web, leveraging the indicator away from the hook or cross member and lifting it up and off the web.

13. The method according to claim 12, wherein:

the notch is adjacent the hook.

14. The method according to claim 12, wherein:

the rib has a beveled portion adjacent the notch.

15. The method according to claim 12, wherein:

the notch is adjacent the cross member.

16. A method of attaching an indicator to a web on a garment hanger, said indicator being substantially U-shaped with a base and two legs, said legs having inwardly extending fingers and distal edges, said garment hanger having a hook and a cross member with the web extending therebetween, the web defining an edge and a valley adjacent the edge, and said edge defining a rib, the rib having a beveled portion and a notch adjacent the beveled portion of the rib and adjacent one of the hook and the cross member, said method comprising:

attaching the indicator to the web by placing the legs at an end of the indicator over the notch with the indicator angled relative to the rib; and pushing the indicator toward the valley such that the distal edges of the legs of the indicator pass over the said rib, followed by the fingers such that the fingers are locked by the rib.

17. The method according to claim 16, wherein:

said web includes a ramp adjacent the valley, and when said indicator is pushed toward the valley, the distal edges of the legs abut the ramp.

18. The method according to claim 16, wherein:

when said fingers pass over said rib, an audible sound is made.

19. A garment hanger, comprising:

a cross member;

a hook extending up from said cross member; and a web extending between the hook and the cross member, said web defining an edge, said edge defining a rib having a long axis, said rib having a beveled portion, said beveled portion tapering down in height as it extends along said long axis.

20. A garment hanger according to claim 19, wherein:

said beveled portion of said rib tapers down in width as it extends along said long axis.

* * * * *